US006082116A

United States Patent [19]

Tunkel et al.

[11] Patent Number: 6,082,116

[45] **Date of Patent: *Jul. 4, 2000**

[54] VORTEX PILOT GAS HEATER

[75] Inventors: Lev Tunkel, Edison, N.J.; Boris Krasovitski, Nesher, Israel

[73] Assignee: Universal Vortex, Inc., Robbinsville, N.J.

[ * ] Notice: This patent is subject to a terminal disclaimer.

[21] Appl. No.: 09/114,032

[22] Filed: Jul. 10, 1998

[51] Int. Cl.[7] ..... F25B 9/02

[52] U.S. Cl. ..... 62/5; 62/87; 62/401

[58] Field of Search ..... 62/5, 87, 401

[56] References Cited

U.S. PATENT DOCUMENTS

| | | | |
|---|---|---|---|
| 2,920,457 | 1/1960 | Bartlett | 62/5 |
| 3,118,286 | 1/1964 | Schroeder | 62/5 |
| 3,942,330 | 3/1976 | Schroder | 62/5 |
| 5,582,012 | 12/1996 | Tunkel et al. | 62/5 |
| 5,911,740 | 6/1999 | Tunkel et al. | 62/5 |

*Primary Examiner*—William Doerrler

*Attorney, Agent, or Firm*—McAulay Nissen; Goldberg & Kiel, LLP

[57] ABSTRACT

A vortex heater to transfer a vortex flow's heat flux to a separate gas flow in a system including a vortex tube having a slender tube plugged at the far end, fins attached to the slender tube's outer side and a shell which includes enclosing the finned vortex slender tube with the shell, thus forming an outer wall of the heat exchanger, connecting a vortex tube's inlet with a source of compressed gas and then discharging the gas flow through vortex tube's diaphragm to provide for the gas flow to undergo an energy separation in the vortex tube, connecting a separate gas flow with the heat exchanger inlet, and discharging this flow from the heat exchanger outlet, to provide for the vortex flow to cool down and for the heat exchanger's flow to heat up.

4 Claims, 1 Drawing Sheet

VORTEX PILOT GAS HEATER

FIELD OF THE INVENTION

This invention is concerned with vortex tubes. More particularly, the present invention relates to the vortex tube's based technology to prevent pilot gas freeze up at gas pressure regulation stations.

The patent application is based on the material contained in Disclosure Document No. 436074, filed on May 5, 1998, in the name of the inventors of this application.

DESCRIPTION OF THE PRIOR ART

It is known to use a vortex tube for an energy separation when the vortex tube is fed with a compressible fluid under a positive (e.g., above atmospheric) pressure. In a vortex tube, the initial flow is transformed into two separate currents of a different internal energy (a cold and a hot fraction) leaving the vortex tube under pressure which is less than the inlet pressure but at a pressure still above atmospheric.

A vortex tube comprises a slender tube with a diaphragm closing one end of the tube provided with a hole in the center of the diaphragm for discharge of the cold fraction, one or more tangential inlet nozzles piercing the tube just inside of the diaphragm, and a controlled hot fraction discharge opening such as a throttle valve or any other restrictive body at the far end or the other end of the slender tube.

Even today, the full theory of the vortex tube, explaining all its features, has not yet been created or established. However, the principal mechanism of the vortex phenomenon can be described in the following manner. An expanding gas after passing through the tangential nozzle develops into a high speed rotating body or a vortex. The gas in the vortex is cooled because part of its total energy converts into kinetic energy. An angular velocity in the vortex is low at the periphery zone and very high toward the center zone. Friction between the central and periphery zones reduces all the gas to the same angular velocity as in a solid body. This causes the inner layers to slow down and the outer layers to speed up. As a result, the inner layers lose part of their kinetic energy and their total temperature decreases. The periphery layers receive the energy from the internal layers. This energy converts to heat through friction on the vortex tube's walls.

The vortex tube's cooling efficiency may be increased with the provision of the heat transfer outside the vortex tube's wall. This leads to a reduction of the hot fraction actual temperature and accordingly to a reduction of a heat flow directed, due to the gas heat convection and conductivity, from the vortex periphery to the vortex center (opposed to the flow of kinetic energy). The thermal energy transferred outside of the vortex tube's walls can be used to heat up a separate gas or liquid flow. At this point the vortex tube performs as a heater.

Obviously, the best result with the heat transfer approach may be obtained with such vortex tube's mode of operation which features the largest temperature gradient in the swirling flow. In this case, the largest heat flux might be transferred outside the vortex tube's walls.

We have found both theoretically and experimentally that the largest temperature gradient is typical for the vortex tube operating with its throttle valve on the far end of the slender tube completely closed.

It means that at this mode of operation the internal (cold) and the external (hot) vortex layers, prior to its mixing up at the vortex tube's diaphragm discharge opening, have, accordingly, the lowest and highest value of their absolute temperature.

SUMMARY OF THE INVENTION

To this end, the present invention consists of the provision of the heat flux transfer outside of the vortex tube's wall, and further in applying this thermal energy to heat up gas in the control pilot of the gas pressure regulators.

DETAILED DESCRIPTION OF THE PREFERRED EMBODIMENTS

Figure 1:
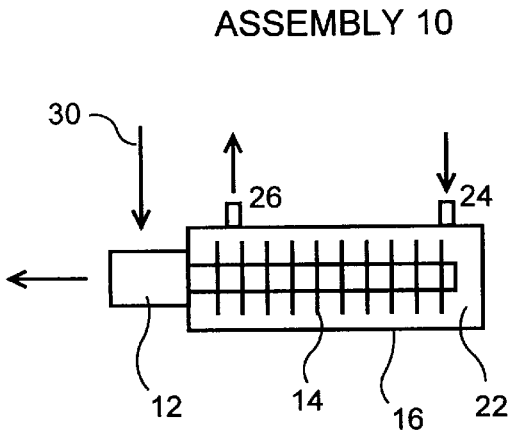
FIG. 1 is a schematic design and flow diagram of one embodiment according to the invention.

The schematic design and flow diagram of FIG. 1 illustrates one embodiment of the present invention, an assembly 10 providing for the heat transfer enhancement in the vortex tube. It includes a vortex tube 12 with its slender tube plugged at the far end, fins 14 attached to the slender tube's outer side and a shell 16 which encloses a finned slender tube thus forming an outer wall of the heat exchanger 22.

A gas flow enters assembly 10 in the direction of arrow 30 through the vortex tube's nozzles and then undergoes an energy separation.

A separate gas flow or a liquid enters the heat exchanger 22 through its inlet opening 24 and then, moving to the outlet opening 26 alongside the finned vortex tube's outer surface, picks up heat transferred from the hot vortex layers to the vortex tube's finned outer walls. As a result of the energy transfer, the vortex combined flow (cold internal layers and cooled external layers) leaves the vortex tube's diaphragm with the temperature substantially lower than the vortex tube's inlet flow temperature, while the flow leaving the heat exchanger has a temperature substantially higher than the heat exchanger's inlet flow temperature. Thus, the method according to the flow diagram of FIG. 1 may be used multi-purposely: for gas stream(s) cooling, heating (vortex heater) or cooling and heating.

Figure 2:
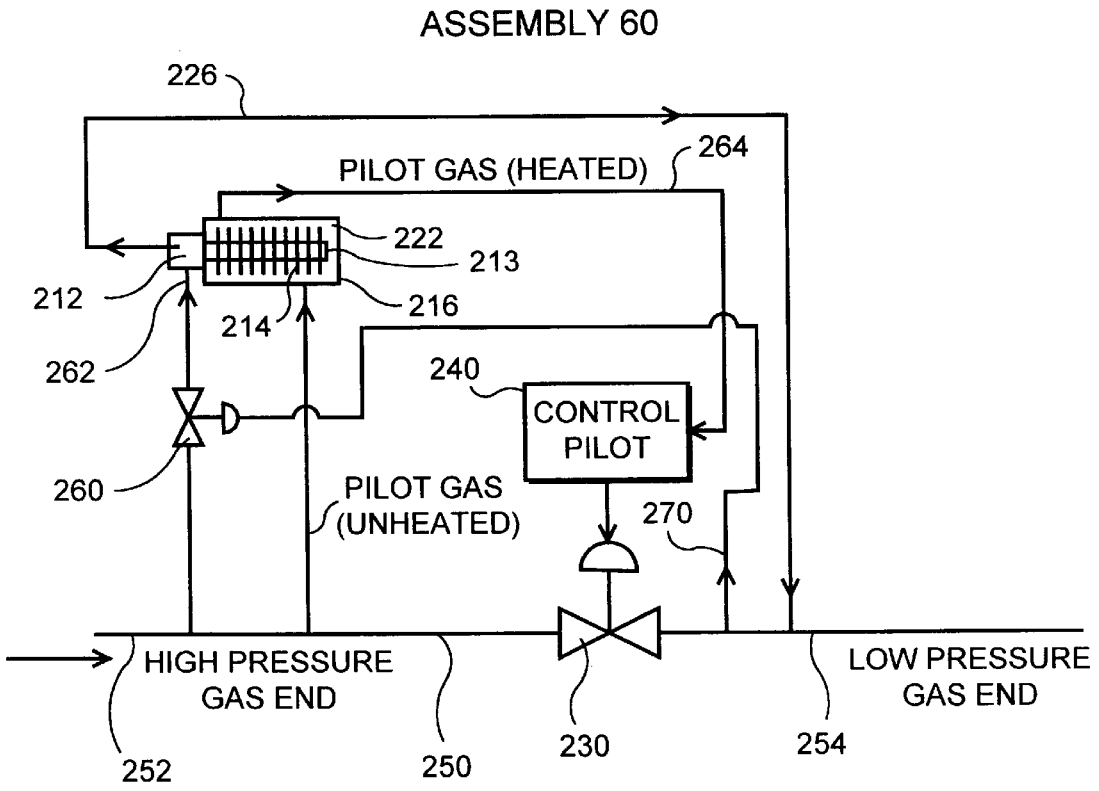
FIG. 2 is a schematic design and flow diagram of another embodiment of the invention.

Another area of technology in connection with this embodiment and with the other embodiments in FIGS. 1 and 2 also provides for the interchange of inlet opening 24 and outlet opening 26 such that the gas or the liquid can be arranged to enter into heat exchanger 22 through opening 26 which then becomes an inlet opening and the gas or the liquid exits from heat exchanger 22 through opening 24 which then becomes an outlet opening.

Another embodiment of the invention which provides to heat up pilot gas with a vortex heater to prevent pilot gas freeze up at the natural gas pressure regulation stations is shown in FIG. 2. As it is shown on the schematic design and flow diagram in FIG. 2, an assembly 60 to operate at the natural gas pressure regulation station comprises a vortex tube 212 with its slender tube plugged at the far end, fins 214 attached to the slender tube's outer side, a shell 216, which encloses a finned slender tube thus forming an outer wall of the heat exchanger 222, a gas pressure regulator 230 set up on a gas delivery line 250 and a control pilot 240 hydraulically connected with a pressure regulator.

An assembly 60 may be used for any gas composition treatment, providing there is a possibility of the control pilot gas freeze up under internal and/or external chilling. However, the main area of the presented embodiment application is an oil and gas industry, where natural/associated gas' pressure drop accompanies with gas temperature drop (Joule-Thomson effect). Under these circumstances a pilot gas flow (a small vulnerable fraction of the delivery gas flow) needs to be heated up, especially under low ambient temperature (external impact).

A high pressure gas flow enters gas pressure regulator 230 and leaves it with a desirable lower pressure which is monitored by the control pilot 240. In order to monitor the regulator's work the pilot's inlet is connected with the high pressure delivery line and its outlet is connected with the low pressure delivery line; the pilot gas pressure drop occurs in the pilot's throttle. The vortex tube inlet 262 is connected with the inlet end of gas delivery line 250 prior to gas pressure regulator 230 and the vortex tube's outlet 226 is dumped into low pressure end 254 of the gas delivery line 250. Since the vortex flow is a small (2–5%) fraction of the delivery flow, there is no distortion in the pre-set downstream gas flow pattern. A high pressure pilot gas flow enters a vortex heater's heat exchanger at 222 to pick up thermal energy from the vortex tube's walls and then is directed through line 264 to the control pilot 240 where its undergo gas pressure and simultaneously gas temperature reduction. However, since the increase of the gas temperature in the vortex heater is more than the value of the Joule-Thomson effect, the pilot gas in the control pilot remains under thermodynamic conditions which eliminates its freezing. In order to respond to the low or zero delivered gas flow rate demand, a shut off valve 260 is set up prior to the vortex heater inlet 262. This valve operates in two modes: fully open or fully closed and it is monitored by the downstream pressure sensor 270. The vortex heater features a provision for non freeze gas depressurization in the vortex tube. At this point, a heated vortex flow prior to exiting the vortex tube is directed to warm up the vortex tube's inlet cross-section where Joule-Thomson temperature drop occurs.

While there has been shown and described what is considered to be the preferred embodiment of the patent disclosure, various changes and modifications may be made therein without departing from the scope of the invention.

What is claimed is:

1. A vortex heater to transfer a vortex flow's heat flux to a separate gas flow in a system including a vortex tube having a slender tube plugged at the far end, fins attached to the slender tube's outer side and a shell comprising the steps of:

a) enclosing the finned vortex slender tube with the shell, thus forming an outer wall of the heat exchanger;

b) connecting a vortex tube's inlet with a source of compressed gas and then discharging the gas flow through vortex tube's diaphragm, thus providing for the gas flow to undergo an energy separation in the vortex tube;

c) connecting a separate gas flow with the heat exchanger inlet; and then d) discharging this flow from the heat exchanger outlet, thus providing for the vortex flow to cool down and for the heat exchanger's flow to heat up.

2. A vortex heater to transfer a vortex flow's heat flux to a separate pilot gas flow in a system including a gas pressure regulator set up on a gas delivery line, a control pilot hydraulically connected with a pressure regulator, a vortex tube having a slender tube plugged at the far end, fins attached to the slender tube's outer side and a shell, comprising the steps of:

a) enclosing the finned vortex slender tube with the shell, thus forming an outer wall of a heat exchanger;

b) connecting a vortex tube's inlet with a high pressure end of the gas delivery line upstream of the pressure regulator;

c) connecting a vortex tube's outlet formed by a diaphragm opening with a low pressure end of the gas delivery line downstream of the pressure regulator;

d) discharging the gas flow through vortex tube's diaphragm opening, thus providing for the gas flow to undergo an energy separation in the vortex tube;

e) directing a separate high pressure pilot gas flow talking from the gas delivery line prior to the gas pressure regulator to the heat exchanger; and f) directing a heated high pressure pilot gas flow from the heat exchanger to the pilot, thus providing for the pilot gas a non freeze pressure drop in the control pilot.

3. The vortex heater of claim 2, wherein a shutoff valve monitored by the downstream pressure sensor is set up prior to the vortex tube's inlet in order to respond to the low or zero delivered gas flow demand.

4. The vortex heater of claim 2, wherein a heated vortex flow prior to exiting the vortex tube is directed to warm up the vortex tube's inlet cross-section where Joule-Thomson temperature drop occurs.

* * * * *